US011721301B1

(12) United States Patent
Lan et al.

(10) Patent No.: US 11,721,301 B1
(45) Date of Patent: Aug. 8, 2023

(54) CHARGING COMPENSATION DEVICE, DISPLAY TERMINAL, AND CHARGING COMPENSATION METHOD

(71) Applicant: TCL China Star Optoelectronics Technology Co., Ltd., Guangdong (CN)

(72) Inventors: Qingsheng Lan, Guangdong (CN); Youngil Ban, Guangdong (CN)

(73) Assignee: TCL China Star Optoelectronics Technology Co., Ltd., Shenzhen (CN)

( * ) Notice: Subject to any disclaimer, the term of this patent is extended or adjusted under 35 U.S.C. 154(b) by 0 days.

(21) Appl. No.: 17/897,333

(22) Filed: Aug. 29, 2022

(30) Foreign Application Priority Data

Jul. 26, 2022 (CN) ..... 202210882486.0

(51) Int. Cl.
*G09G 3/20* (2006.01)
*G09G 3/36* (2006.01)

(52) U.S. Cl.
CPC ... *G09G 3/3688* (2013.01); *G09G 2310/0291* (2013.01); *G09G 2310/08* (2013.01)

(58) Field of Classification Search
CPC ..... G09G 2320/0223
See application file for complete search history.

(56) References Cited

U.S. PATENT DOCUMENTS

2020/0234622 A1* 7/2020 Xiong ..... G09G 3/20

* cited by examiner

*Primary Examiner* — Nan-Ying Yang

(57) ABSTRACT

A charging compensation device includes: a timing control module configured to send a display data and a current row number information of a display panel; a driving module electrically connected to the timing control module, configured to divide the display data into at least two charging intervals according to a received row number information, and configured to determine a plurality of charging currents according to the at least two charging intervals, wherein each of the charging intervals corresponds to the display data of multiple rows of the pixel units, and distances between the pixel units corresponding to each of the charging intervals and the driving module are different; and an output module electrically connected to the driving module and configured to charge the display panel according to the plurality of charging currents.

9 Claims, 3 Drawing Sheets

CHARGING COMPENSATION DEVICE, DISPLAY TERMINAL, AND CHARGING COMPENSATION METHOD

RELATED APPLICATIONS

This application claims the benefit of priority of Chinese Patent Application No. 202210882486.0 filed on Jul. 26, 2022, the contents of which are incorporated by reference as if fully set forth herein in their entirety.

FIELD OF THE DISCLOSURE

The present application relates to the technical field of display technologies, and more particularly, to a charging compensation device, a display terminal, and a charging compensation method.

BACKGROUND

With a rapid development of smart TV technology iterations, TVs are gradually developing in a direction of large size and high resolution, and users' requirements for smart TV display performances are getting higher and higher. For example, TVs have developed from the earlier 32 inches to the more popular 55 inches, 65 inches, etc., and even larger TVs that exceed 100 inches.

In the related art, liquid crystal displays mainly rely on a driving chip to receive a display data transmitted from a timing controller to complete the processing and conversion of the display data. Then, the converted display data is output to a liquid crystal display panel for display through an output channel of the driving chip. The output channel of the driving chip outputs the converted display data to the liquid crystal display panel for display. That is, the charging process of the output channel of the driving chip to the display panel.

However, as the size of the display panel becomes larger and larger, it means that the driving chip for driving the display panel for display has a stronger carrying capacity, and the large size of the display panel also means that a charging uniformity of the display panel may become a major challenge. In addition, a difference in charging between a far end and a near end of the display panel by the driving chip becomes more and more prominent, resulting in a large difference in brightness between a side of the display panel close to the driving chip and a side far from the driving chip, which affects a taste of the display panel.

SUMMARY

In view of this, the present application provides a charging compensation device, a display terminal, and a charging compensation method, which can adjust a size of a charging current according to a distance between different charging intervals and a driving module, reduce a difference of charging at different positions of the display panel, further improve a phenomenon of uneven charging of the display panel, and enhance a taste of the display panel.

According to an aspect of the present application, a charging compensation device is provided, the charging compensation device is applied to a display panel, the display panel comprises a plurality of pixel units arranged in an array, and the charging compensation device comprises: a timing control module configured to send a display data and a current row number information of the display panel; a driving module electrically connected to the timing control module, configured to divide the display data into at least two charging intervals according to a received row number information, and configured to determine a plurality of charging currents according to the at least two charging intervals, wherein each of the charging intervals corresponds to the display data of multiple rows of the pixel units, and distances between the pixel units corresponding to each of the charging intervals and the driving module are different; and an output module electrically connected to the driving module and configured to charge the display panel according to the plurality of charging currents.

Further, the driving module further comprises a register module, the register module is electrically connected with the timing control module, and the register module is used to set a number of row number information of the display panel.

Further, the driving module further comprises an interval control module, the interval control module is electrically connected with the timing control module, and the interval control module is configured to divide the display data into the at least two charging intervals according to a received row number information.

Further, the driving module further comprises a current control module, the current control module is electrically connected with the interval control module, and the current control module is configured to determine the plurality of charging currents according to the at least two charging intervals.

Further, the at least two charging intervals comprise a first charging interval and a second charging interval, the first charging interval corresponds to a first charging current, and the second charging interval corresponds to a second charging current.

Further, a distance between a pixel unit corresponding to the first charging interval and the driving module is smaller than a distance between a pixel unit corresponding to the second charging interval and the driving module, and the first charging current corresponding to the first charging interval is smaller than the second charging current corresponding to the second charging interval.

Further, the output module further comprises an operational amplifier, the operational amplifier comprises a first power supply terminal, a second power supply terminal, a positive input terminal, a negative input terminal, and an operational amplifier output terminal, wherein: the first power supply terminal is electrically connected to the current control module; the second power supply terminal is grounded; the positive input terminal is configured to receive the display data corresponding to the charging interval; the negative input terminal is electrically connected to the output terminal of the operational amplifier; and the operational amplifier output terminal is configured to output a driving signal corresponding to the charging interval.

Further, the driving module further comprises a data control module electrically connected to the timing control module and configured to shift, temporarily store, latch, level convert, and analog convert the display data.

According to another aspect of the present application, a display terminal is provided, the display terminal comprises a display panel and the charging compensation device, and the charging compensation device is connected to the display panel.

According to another aspect of the present application, a charging compensation method is provided, the charging compensation method is applied to the charging compensation device, and the charging compensation method comprises: receiving the display data and the current row number information of the display panel; dividing the display data into the at least two charging intervals according to the received row number information, wherein each of the charging intervals corresponds to the display data of multiple rows of the pixel units, and the distances between the pixel units corresponding to each of the charging intervals and the driving module are different; determining the plurality of charging currents according to the at least two charging intervals; and charging the display panel according to the plurality of charging currents.

By receiving the current row number information sent by the timing control module, and then using the driving module to divide the display data into at least two charging intervals according to the received row number information, setting the display data of each of the charging intervals corresponding to multiple rows of pixel units, the distances between the pixel units corresponding to each of the charging intervals and the driving module are different, and multiple charging currents are determined according to the at least two charging intervals, and then the output module is used to charge the display panel according to the plurality of charging currents. According to various aspects of the present application, a magnitude of the charging current can be adjusted according to the distance between different charging intervals and the driving module, thereby reducing a difference of charging at different positions of the display panel, further improving a phenomenon of uneven charging of the display panel, and improving a taste of the display panel.

BRIEF DESCRIPTION OF THE DRAWINGS

The technical solutions and other beneficial effects of the present application will be apparent through the detailed description of the specific embodiments of the present application in conjunction with the accompanying drawings.

DETAILED DESCRIPTION

Figure 1:
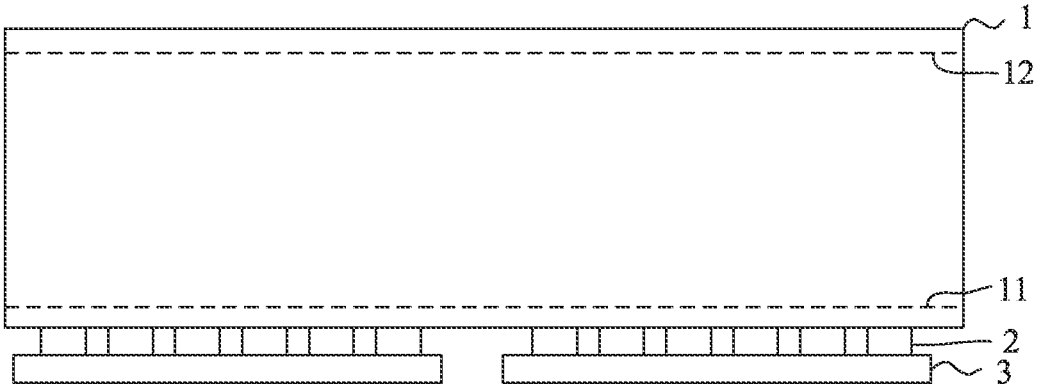
FIG. 1 shows a schematic diagram of a related art display panel.

The technical solutions in the embodiments of the present application will be clearly and completely described below with reference to the accompanying drawings in the embodiments of the present application. Obviously, the described embodiments are only a part of the embodiments of the present application, but not all of the embodiments. Based on the embodiments in this application, all other embodiments obtained by those skilled in the art without creative efforts shall fall within the protection scope of this application.

In the description of this application, it should be understood that the orientation or positional relationship indicated by the term "center", "longitudinal", "lateral", "length", "width", "thickness", "upper", "lower", "front", "rear", "left", "right", "vertical", "horizontal", "top", "bottom", "inner", "outer", "clockwise", "counterclockwise", etc. is based on the orientation or positional relationship shown in the drawings. It is for ease of describing the present application and to simplify the description only and is not intended to indicate or imply that the device or element referred to must have a particular orientation, be constructed, and operate in a particular orientation. Therefore, it should not be construed as a limitation on this application. In addition, the terms "first" and "second" are only used for descriptive purposes and should not be construed as indicating or implying relative importance or implying the number of indicated technical features. Thus, features defined as "first", "second" may expressly or implicitly include one or more of the features. In the description of the present application, "plurality" means two or more, unless otherwise expressly and specifically defined.

In the description of the present application, it should be noted that, unless otherwise expressly specified and limited, the terms "installed", "connected", and "linked" should be construed in a broad sense. For example, it may be a fixed connection, a detachable connection, or an integral connection. It can be a mechanical connection or an electrical connection or can communicate with each other. It can be a direct connection or an indirect connection through an intermediate medium, and it can be the internal communication between the two elements or the interaction relationship between the two elements. For those of ordinary skill in the art, the specific meanings of the above terms in this application can be understood according to specific situations.

The following disclosure provides many different embodiments or examples for implementing different structures of the present application. To simplify the disclosure of the present application, the components and arrangements of specific examples are described below. It is understood that they are only examples and are not intended to limit the application. Furthermore, this application may repeat reference numerals and/or reference letters in different instances. This repetition is for the purpose of simplicity and clarity and does not in itself indicate a relationship between the various embodiments and/or arrangements discussed. In addition, this application provides examples of various specific processes and materials, but one of ordinary skill in the art will recognize the application of other processes and/or the use of other materials. In some instances, methods, means, components, and circuits well known to those skilled in the art have not been described in detail so as not to obscure the subject matter of the present application.

FIG. 1 shows a schematic diagram of a related art display panel.

As shown in FIG. 1, in the related art, a plurality of driving chips 2 and a printed circuit board (PCB) 3 may be disposed on one side of a liquid crystal display panel 1. A plurality of timing controllers 3 are provided on the printed circuit board. The plurality of driving chips are electrically connected to the display panel, and each timing controller is electrically connected to the corresponding plurality of driving chips.

Figure 2:
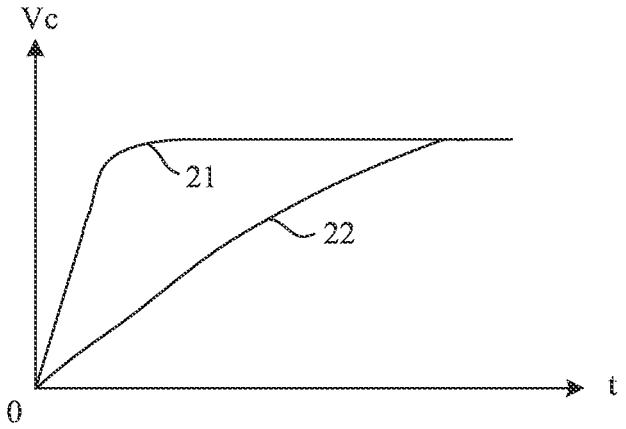
FIG. 2 shows a schematic diagram of a charging voltage waveform of the related art.

FIG. 2 shows a schematic diagram of a charging voltage waveform of the related art.

As shown in FIG. 2, in the related art, Vc is a charging voltage, t is a charging time, and 21 is a charging waveform on a side (i.e., a near end) of the display panel close to the driving chip, corresponding to 11. 22 is a charging waveform of a side (i.e., a far end) away from the driving chip in the display panel, corresponding to 12. It can be seen from FIG. 2 that a rise of the charging waveform at the near end is steeper due to the closer distance to the driving chip. Therefore, pixel units at the near end can be charged to a target charging voltage more quickly. Because it is farther away from the driving chip, the charging waveform at the far end rises more slowly. Therefore, it takes a longer time to charge the pixel units at the far end to the target charging voltage.

Figure 3:
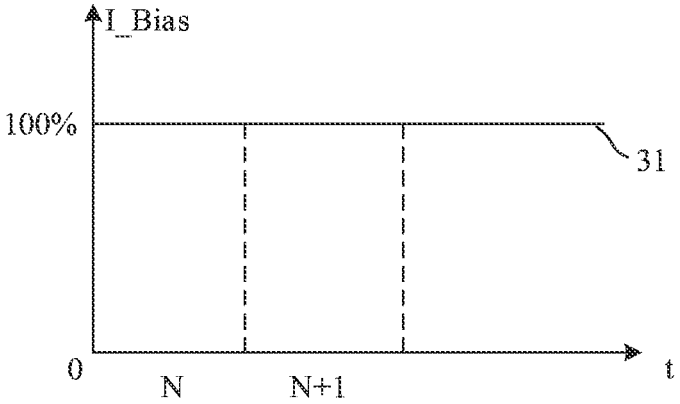
FIG. 3 shows a schematic diagram of a charging current of the related art.

FIG. 3 shows a schematic diagram of a charging current of the related art.

As shown in FIG. 3, in the whole charging process, for example, in the Nth frame charging period and the N+1th frame charging period, a charging current I_Bias is at a level of 100%. That is, a charging current does not change during the entire charging process, and a charging curve 31 is horizontal. Therefore, the difference in charging between the far end and the near end of the display panel by the driving chip becomes more and more prominent, which in turn causes a phenomenon of uneven display performance of the display panel, which affects a taste effect of the display panel.

In view of this, the present application provides a charging compensation device, the charging compensation device is applied to a display panel, the display panel comprises a plurality of pixel units arranged in an array, and the charging compensation device comprises: a timing control module configured to send a display data and a current row number information of the display panel; a driving module electrically connected to the timing control module, configured to divide the display data into at least two charging intervals according to a received row number information, and configured to determine a plurality of charging currents according to the at least two charging intervals, wherein each of the charging intervals corresponds to the display data of multiple rows of the pixel units, and distances between the pixel units corresponding to each of the charging intervals and the driving module are different; and an output module electrically connected to the driving module and configured to charge the display panel according to the plurality of charging currents.

By receiving the current row number information sent by the timing control module, and then using the driving module to divide the display data into at least two charging intervals according to the received row number information, setting the display data of each of the charging intervals corresponding to multiple rows of pixel units, the distances between the pixel units corresponding to each of the charging intervals and the driving module are different, and multiple charging currents are determined according to the at least two charging intervals, and then the output module is used to charge the display panel according to the plurality of charging currents. The present application can adjust a size of the charging current according to a distance between different charging intervals and the driving module, reduce a difference of charging at different positions of the display panel, further improve a phenomenon of uneven charging of the display panel, and improve a taste of the display panel.

Figure 4:
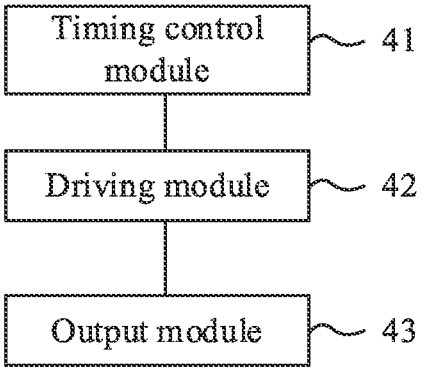
FIG. 4 shows a block diagram of a charging compensation device according to an embodiment of the present application.

FIG. 4 shows a block diagram of a charging compensation device according to an embodiment of the present application.

As shown in FIG. 4, the charging compensation device according to the embodiment of the present application may include a timing control module 41, a driving module 42, and an output module 43. The driving module 42 can be electrically connected to the timing control module 41 and the output module 43 respectively. It should be noted that the charging compensation device can be used in a liquid crystal display panel. In other types of display panels, such as OLEDs, corresponding improvements can also be made to the charging method of the display panel based on the inventive concept of the present application. The present application does not limit the type of the display panel. Hereinafter, the embodiments of the present application will be described by taking a liquid crystal display panel as an example.

Specifically, the timing control module 41 may be a timing controller (i.e., TCON). The timing control module can be used to send a display data. In a liquid crystal display panel, the display data may be a data set including corresponding data to be loaded by a plurality of pixel units. Because the focus of the present application is to solve the issue of uneven charging caused by different distances from the driving chip, the display data in this embodiment of the present application may be divided into rows. That is, the display data corresponding to each row of pixel units can be used as a basic data unit. It should be noted that, because the row and column of the display panel can be converted, the "row" in this application can also be equally replaced by the "column".

Further, the driving module further includes a register module. The register module is electrically connected to the timing control module. The register module is used to set the row number information of the display panel. The register module may be a single register or a register group.

Before starting to charge the display panel, the number of rows of the display panel to be displayed may be set in the register module first, so as to determine the multi-row pixel units to be displayed in the display panel. The set row number information can be sent to the timing control module, and the timing control module can determine the display data corresponding to the row number information according to the received row number information. At different moments, the row number information determined by the timing control module may be different. For example, in one display cycle, the timing control module may send the display data corresponding to 1024 rows of pixel units. In another display period, the timing control module can send the display data corresponding to 2048 rows of pixel units.

Further, the display panel includes a plurality of pixel units arranged in an array. The driving module further includes an interval control module. The interval control module is electrically connected with the timing control module. The interval control module is configured to divide the display data into at least two charging intervals according to the received row number information.

The interval control module can be electrically connected with the timing control module to receive the current number of rows of the display panel sent by the timing control module. After receiving the current row number information of the display panel sent by the timing control module, the interval control module may divide at least two charging intervals according to the received row number information. Exemplarily, the at least two charging intervals include a first charging interval and a second charging interval. It is understood that multiple charging sections such as three charging sections and four charging sections may also be divided. The present application does not limit the number of the charging intervals.

Taking the at least two charging intervals including the first charging interval and the second charging interval as an example, in the case that the row number information is 1024 rows, the 1024 rows may be divided into two parts. The first charging interval corresponds to the pixel units in the first 512 rows, and the second charging interval corresponds to the pixel units in the last 512 rows. The target charging voltages of the plurality of rows of pixel units corresponding to each charging interval may be the same. That is, for a certain charging interval, the charging method in the charging interval can be the same as the charging method shown in FIG. 2 and FIG. 3 in the related art.

Further, the driving module further includes a current control module. The current control module is electrically connected to the interval control module. The current control module is configured to determine a plurality of charging currents according to the at least two charging intervals.

Exemplarily, the first charging interval corresponds to a first charging current, and the second charging interval corresponds to a second charging current. That is, the charging current corresponding to each charging interval may be different. Specifically, when there are multiple charging intervals, the charging current corresponding to each charging interval can be changed in steps. For example, when the at least two charging intervals include four charging intervals, the corresponding charging currents may be 25% Imax, 50% Imax, 75% Imax, and 100% Imax, respectively. Imax is the maximum charging current.

Further, the distance between the pixel unit corresponding to the first charging interval and the driving module is smaller than the distance between the pixel unit corresponding to the second charging interval and the driving module. The first charging current corresponding to the first charging interval is smaller than the second charging current corresponding to the second charging interval.

That is to say, the closer the pixel unit corresponding to the charging interval is to the driving module, the smaller the charging current corresponding to the charging interval. Conversely, the farther the pixel unit corresponding to the charging interval is from the driving module, the greater the charging current corresponding to the charging interval. Therefore, the present application can adjust the size of the charging current according to the distance between different charging intervals and the driving module. This reduces the difference of charging at different positions of the display panel, thereby improving the phenomenon of uneven charging of the display panel and improving the taste of the display panel.

Figure 5:
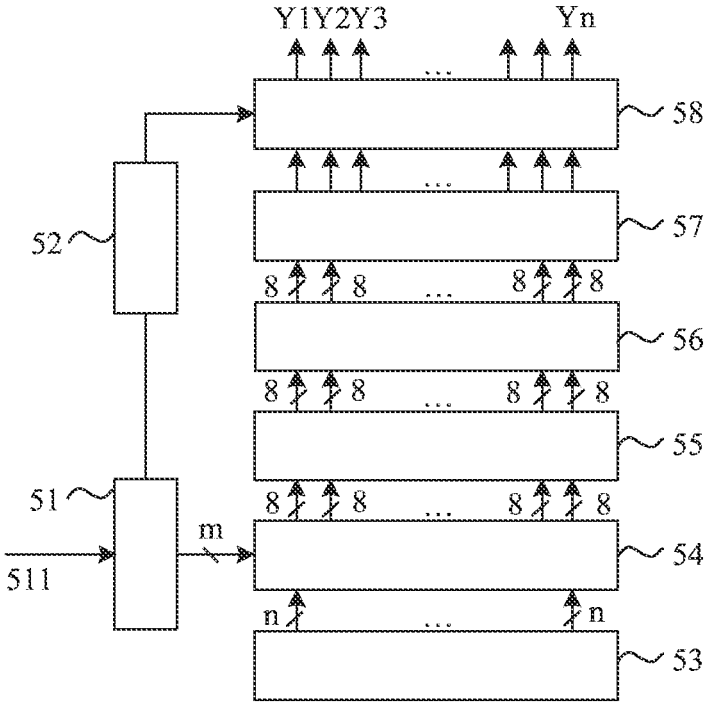
FIG. 5 shows a schematic diagram of a driving module according to an embodiment of the present application.

FIG. 5 shows a schematic diagram of a driving module according to an embodiment of the present application.

As shown in FIG. 5, the driving module may include an interface input module 51, a zone control module 52 and a data control module. 511 may be a display data corresponding to multiple rows of pixel units input into the driving module. 51 may be an interface input module for receiving input display data. The zone control module 52 may include the zone control module and the current control module. In addition, the driving module may further include a data control module. The data control module is electrically connected to the timing control module, and is used for shifting, temporarily storing, latching, level shifting, and digitizing the display data. Specifically, the data control module may include a digital shift module 53, a digital temporary storage module 54, a digital latch module 55, a level conversion module 56, and a digital and analog converting module 57, which are respectively used for shifting, temporarily storing, latching, level converting, and analog converting the display data. Exemplarily, the data output by the interface input module 51 is m bits. The data output by the digital shift module 53 is n bits. The data output by the digital temporary storage module 54, the digital latch module 55, the level conversion module 56, and the digital and analog conversion module 57 are all 8 bits.

Further, the output module further includes an operational amplifier. As shown in FIG. 5, the operational amplifier module 58 may be electrically connected to the zone control module 52. There may be multiple operational amplifiers in the operational amplifier module 58 to output multiple driving signals Y1, Y2 . . . Yn.

Further, the output module further comprises an operational amplifier, the operational amplifier comprises a first power supply terminal, a second power supply terminal, a positive input terminal, a negative input terminal, and an operational amplifier output terminal, wherein: the first power supply terminal is electrically connected to the current control module; the second power supply terminal is grounded; the positive input terminal is configured to receive the display data corresponding to the charging interval; the negative input terminal is electrically connected to the output terminal of the operational amplifier; and the operational amplifier output terminal is configured to output a driving signal corresponding to the charging interval.

Figure 6:
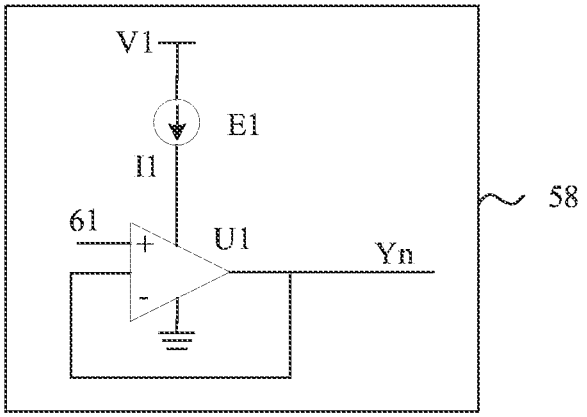
FIG. 6 shows a schematic diagram of an operational amplifier according to an embodiment of the present application.

FIG. 6 shows a schematic diagram of an operational amplifier according to an embodiment of the present application.

As shown in FIG. 6, a positive input terminal 61 of an operational amplifier U1 in the operational amplifier module 58 can be electrically connected to the converted display data corresponding to the charging interval. The negative input terminal can be electrically connected to its own output terminal. The first power supply terminal can be electrically connected to the preset first power supply voltage V1. E1 can be a variable current source to indicate where the current I1 can be adjusted. The second power terminal can be directly grounded. The output terminal of the operational amplifier can output the driving signal corresponding to the charging interval. It should be noted that the driving signal may be a data signal on a data line or a scan signal on a scan line, which is not limited in this application.

Figure 7:
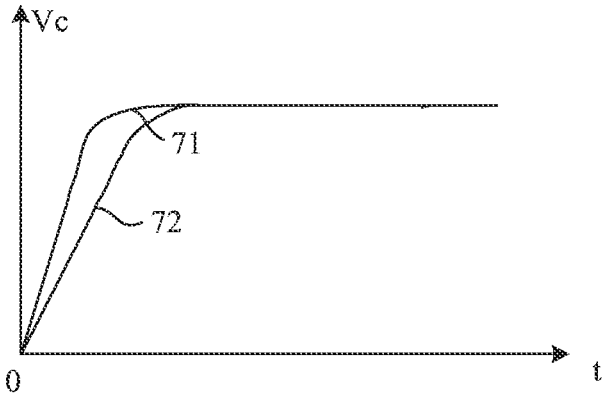
FIG. 7 shows a schematic diagram of a charging voltage waveform according to an embodiment of the present application.

FIG. 7 shows a schematic diagram of a charging voltage waveform in an embodiment of the present application.

As shown in FIG. 7,71 is the charging voltage waveform corresponding to the first charging interval, and the first charging interval is closer to the driving module and is the near end of the display panel. 72 is the voltage waveform corresponding to the second charging interval. The second charging interval is farther from the driving module and is the far end of the display panel. It can be seen that, compared with FIG. 2, the difference between the charging voltage waveform at the far end of the display panel and the charging voltage waveform at the near end of the display panel is smaller, which can improve the difference between the near end charging and the far end charging of the display panel.

Figure 8:
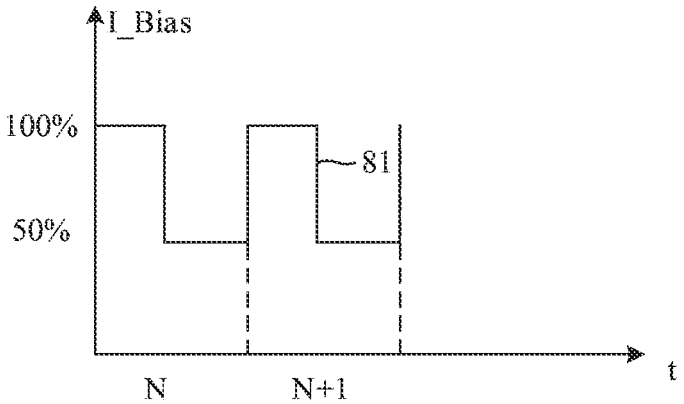
FIG. 8 shows a schematic diagram of a charging current of an embodiment according to the present application.

FIG. 8 shows a schematic diagram of the charging current according to an embodiment of the present application.

As shown in FIG. 8, the display panel can be charged periodically. During the first half of the Nth charging cycle, the charging current I_Bias (i.e., I1) can be 100% Imax. During the second half of the Nth charging cycle, the charging current I_Bias may be 50% of Imax. Imax can be the maximum value of the charging current, which can be set according to actual needs. A charging curve 81 is a square wave. Therefore, in one charging cycle, the charging current changes stepwise according to different charging intervals. Because the charging interval is associated with the distance between the corresponding pixel unit and the driving module, the magnitude of the charging current can be adjusted according to the distance between the charging interval and the driving module. This reduces the difference of charging at different positions of the display panel, thereby improving the phenomenon of uneven charging of the display panel and improving the taste of the display panel.

The present application also provides a display terminal, where the display terminal includes a display panel and the charging compensation device. The charging compensation device is connected with the display panel. The display terminal may be a display device of various sizes, such as a mobile phone, a tablet, a computer, and a wearable device, which is not limited in this application.

In addition, the present application also provides a charging compensation method, the charging compensation method is applied to the charging compensation device, and the charging compensation method comprises: Step S1: receiving the display data and the current row number information of the display panel; step S2: dividing the display data into the at least two charging intervals according to the received row number information, wherein each of the charging intervals corresponds to the display data of multiple rows of the pixel units, and the distances between the pixel units corresponding to each of the charging intervals and the driving module are different; step S3: determining the plurality of charging currents according to the at least two charging intervals; and step S4: charging the display panel according to the plurality of charging currents.

Receiving the display data and the current row number information of the display panel may include:

Step S11: Acquiring a display data sent by the timing control module.

Step S12: Determining the row number information of the display panel according to the display data.

Exemplarily, the display data may include the driving voltage, the position information, and the like of the corresponding pixel unit. The display data may be arranged in the form of a two-dimensional array. The timing control module may count the row number information related to the display data to determine the total number of rows of pixel units to be driven corresponding to the display data.

Further, dividing the display data into at least two charging intervals according to the received row number information may include:

Step S21: Determining the distance between the pixel unit corresponding to the display data and the driving module according to the row number information of the display panel.

In one example, the row number information may include the row number of each row of pixel units corresponding to the display data. The distance between the pixel unit corresponding to the display data and the driving module may be determined by the number of rows where each row of pixel units is located. For example, along the preset direction of the display panel, the number of rows corresponding to the first row of pixel units is 1, such that it can be determined that the distance between the row of pixel units and the driving module is relatively short. The number of rows corresponding to the pixel units in the second row is 2, such that it can be determined that the distance between the pixel units in the row and the driving module is farther than the pixel units in the first row.

Step S22: Grouping the display data according to the distance between the pixel unit corresponding to the display data and the driving module, wherein: the display data located in the same group corresponds to the corresponding multi-row pixel units, and the corresponding charging corresponding interval.

In this step, the same set of display data may correspond to multiple rows of pixel units and correspond to one of the charging intervals. For example, the pixel units in the first row are closer to the pixel units in the second row. The two rows of pixel units may correspond to the same set of display data and correspond to the same charging interval. When charging the pixel units in the display panel, the first row of pixel units and the second row of pixel units corresponding to the set of display data may be charged with the charging current corresponding to the same charging interval. Thus, the pixel units of the first row and the pixel units of the second row are driven to light up.

Further, determining a plurality of charging currents according to the at least two charging intervals, including:

Step S31: Determining the charging current corresponding to the charging interval according to each charging interval.

That is, in the present application, each of the charging sections may correspond to different charging currents, and the charging sections may correspond to the charging currents one-to-one. It can be understood that the application does not limit the mapping relationship between the charging interval and the charging current.

It should be noted that, the charging compensation device may further include a processor, for example, and the processor may be configured to specifically execute the charging compensation method. For the specific details of the charging compensation method, reference may be made to the charging compensation device, and details are not repeated here.

To sum up, in the embodiments of the present application, by receiving the current row number information sent by the timing control module, and then using the driving module to divide the display data into at least two charging intervals according to the received row number information, setting the display data of each of the charging intervals corresponding to multiple rows of pixel units, the distances between the pixel units corresponding to each of the charging intervals and the driving module are different, and multiple charging currents are determined according to the at least two charging intervals, and then the output module is used to charge the display panel according to the plurality of charging currents. A magnitude of the charging current can be adjusted according to the distance between different charging intervals and the driving module, thereby reducing a difference of charging at different positions of the display panel, further improving a phenomenon of uneven charging of the display panel, and improving a taste of the display panel.

In the above-mentioned embodiments, the description of each embodiment has its own emphasis. For parts that are not described in detail in a certain embodiment, reference may be made to the relevant descriptions of other embodiments.

The charging compensation device, the display terminal, and the charging compensation method provided by the embodiments of the present application have been described in detail above. Specific examples are used herein to illustrate the principles and implementations of the present application. The descriptions of the above embodiments are only used to help understand the technical solutions and core ideas of the present application. Those of ordinary skill in the art should understand that they can still make modifications to the technical solutions described in the foregoing embodiments or perform equivalent replacements to some of the technical features. However, these modifications or substitutions do not make the essence of the corresponding technical solutions deviate from the scope of the technical solutions of the embodiments of the present application.

What is claimed is:

1. A charging compensation device, wherein the charging compensation device is applied to a display panel, the display panel comprises a plurality of pixel units arranged in an array, and the charging compensation device comprises:

a timing control module configured to send a display data and a current row number information of the display panel;

a driving module electrically connected to the timing control module, configured to divide the display data into at least two charging intervals according to a received row number information, and configured to determine a plurality of charging currents according to the at least two charging intervals, wherein each of the charging intervals corresponds to the display data of multiple rows of the pixel units, and distances between the pixel units corresponding to each of the charging intervals and the driving module are different; and an output module electrically connected to the driving module and configured to charge the display panel according to the plurality of charging currents;

wherein the driving module further comprises an interval control module, the interval control module is electrically connected with the timing control module, and the interval control module is configured to divide the display data into the at least two charging intervals according to a received row number information;

wherein the driving module further comprises a current control module, the current control module is electrically connected with the interval control module, and the current control module is configured to determine the plurality of charging currents according to the at least two charging intervals; and wherein the output module further comprises an operational amplifier, the operational amplifier comprises a first power supply terminal, a second power supply terminal, a positive input terminal, a negative input terminal, and an operational amplifier output terminal, wherein:

the first power supply terminal is electrically connected to the current control module;

the second power supply terminal is grounded;

the positive input terminal is configured to receive the display data corresponding to the charging interval;

the negative input terminal is electrically connected to the output terminal of the operational amplifier; and the operational amplifier output terminal is configured to output a driving signal corresponding to the charging interval.

2. The charging compensation device of claim 1, wherein the driving module further comprises a register module, the register module is electrically connected with the timing control module, and the register module is used to set a number of row number information of the display panel.

3. The charging compensation device of claim 1, wherein the at least two charging intervals comprise a first charging interval and a second charging interval, the first charging interval corresponds to a first charging current, and the second charging interval corresponds to a second charging current.

4. The charging compensation device of claim 3, wherein a distance between a pixel unit corresponding to the first charging interval and the driving module is smaller than a distance between a pixel unit corresponding to the second charging interval and the driving module, and the first charging current corresponding to the first charging interval is smaller than the second charging current corresponding to the second charging interval.

5. The charging compensation device of claim 1, wherein the driving module further comprises a data control module electrically connected to the timing control module and configured to shift, temporarily store, latch, level convert, and analog convert the display data.

6. A display terminal, comprising:

a display panel; and a charging compensation device connected to the display panel;

wherein the charging compensation device is applied to the display panel, the display panel comprises a plurality of pixel units arranged in an array, and the charging compensation device comprises:

a timing control module configured to send a display data and a current row number information of the display panel;

a driving module electrically connected to the timing control module, configured to divide the display data into at least two charging intervals according to a received row number information, and configured to determine a plurality of charging currents according to the at least two charging intervals, wherein each of the charging intervals corresponds to the display data of multiple rows of the pixel units, and distances between the pixel units corresponding to each of the charging intervals and the driving module are different; and an output module electrically connected to the driving module and configured to charge the display panel according to the plurality of charging currents;

wherein the driving module further comprises an interval control module, the interval control module is electrically connected with the timing control module, and the interval control module is configured to divide the display data into the at least two charging intervals according to a received row number information;

wherein the driving module further comprises a current control module, the current control module is electrically connected with the interval control module, and the current control module is configured to determine the plurality of charging currents according to the at least two charging intervals; and wherein the output module further comprises an operational amplifier, the operational amplifier comprises a first power supply terminal, a second power supply terminal, a positive input terminal, a negative input terminal, and an operational amplifier output terminal, wherein:

the first power supply terminal is electrically connected to the current control module;

the second power supply terminal is grounded;

the positive input terminal is configured to receive the display data corresponding to the charging interval;

the negative input terminal is electrically connected to the output terminal of the operational amplifier; and the operational amplifier output terminal is configured to output a driving signal corresponding to the charging interval.

7. The display terminal of claim 6, wherein the driving module further comprises a register module, the register module is electrically connected with the timing control module, and the register module is used to set a number of row number information of the display panel.

8. The display terminal of claim 6, wherein the at least two charging intervals comprise a first charging interval and a second charging interval, the first charging interval corresponds to a first charging current, and the second charging interval corresponds to a second charging current.

9. The display terminal of claim 8, wherein a distance between a pixel unit corresponding to the first charging interval and the driving module is smaller than a distance between a pixel unit corresponding to the second charging interval and the driving module, and the first charging current corresponding to the first charging interval is smaller than the second charging current corresponding to the second charging interval.

* * * * *